US008714174B1

(12) United States Patent
DeSousa

(10) Patent No.: US 8,714,174 B1
(45) Date of Patent: May 6, 2014

(54) CANOPY WEIGHT CASE

(76) Inventor: Daniel Anthony DeSousa, Clayton, CA (US)

( * ) Notice: Subject to any disclaimer, the term of this patent is extended or adjusted under 35 U.S.C. 154(b) by 45 days.

(21) Appl. No.: 13/531,961

(22) Filed: Jun. 25, 2012

Related U.S. Application Data

(60) Provisional application No. 61/572,437, filed on Jul. 15, 2011.

(51) Int. Cl.
*E04H 15/62* (2006.01)

(52) U.S. Cl.
USPC ..... 135/118; 135/95; 135/117; 135/120.4; 248/508; 248/529

(58) Field of Classification Search
USPC ..... 135/96, 98, 16, 123, 118, 119, 120.1, 135/120.4, 904, 95, 114, 117; 248/507–508, 510, 364, 188.3, 188.8, 248/165, 163.2, 364.01, 346.2, 519, 529, 248/910; 47/20.1, 66.6, 67
See application file for complete search history.

(56) References Cited

U.S. PATENT DOCUMENTS

| | | | | | |
|---|---|---|---|---|---|
| 998,093 | A * | 7/1911 | Hill | 135/120.1 |
| 3,415,475 | A * | 12/1968 | Goodman | 248/158 |
| 5,020,764 | A * | 6/1991 | Yamamoto | 248/529 |
| 5,158,281 | A * | 10/1992 | Williams | 473/483 |
| 5,737,883 | A | 4/1998 | Rose | |
| 6,240,940 | B1 | 6/2001 | Carter | |
| 6,539,665 | B1 * | 4/2003 | Llona | 47/65.5 |
| 6,619,610 | B1 | 9/2003 | Genovese | |
| 6,789,916 | B2 * | 9/2004 | Ruggles | 362/154 |
| 6,981,680 | B1 | 1/2006 | Gordon et al. | |
| 7,721,748 | B2 * | 5/2010 | Dreamwalker | 135/114 |
| 7,958,670 | B2 * | 6/2011 | Kamau | 47/66.6 |
| 8,500,609 | B1 * | 8/2013 | Williams | 482/108 |
| 2011/0023922 | A1 | 2/2011 | Rees, Jr. | |
| 2012/0017960 | A1 * | 1/2012 | Doell | 135/120.1 |

FOREIGN PATENT DOCUMENTS

| | | | |
|---|---|---|---|
| JP | 07293049 | A * | 11/1995 |
| JP | 2005155063 | A * | 6/2005 |
| WO | WO 2005005755 | A1 * | 1/2005 |

* cited by examiner

*Primary Examiner* — Winnie Yip

(57) ABSTRACT

A method of applying weights to the legs of instant pop-up canopies and the like is disclosed. The weights help prevent uplift under windy conditions. Each weight case is comprised of two half-round hollow cases. The case halves are joined by hinges on one edge and latches on the opposite edge. Each case half has a full length inner V-groove, which when closed, create a throughbore for the canopy legs. Each case half top is fitted with a filler hole and cap. The hollow cases can be filled with a variety of weight material. The weighted case is wrapped around the lower leg of the canopy and latched shut to secure the weight around the canopy leg. The weight case rests on the flanged footplate of each leg. Four to six weight cases are required for each application.

2 Claims, 6 Drawing Sheets

FIG. 3

CANOPY WEIGHT CASE

CROSS-REFERENCE TO RELATED APPLICATIONS

This application claims the benefit of Provisional Patent Application No. 61/572,437 filed on 2011 Jul. 15 by the present inventor.

BACKGROUND OF THE INVENTION

This invention relates to portable weights used to stabilize instant pop-up canopies, portable gazebos, and any other suitable free-standing tent-like structures against wind uplift. More specifically it relates to a new and novel method of applying portable weights to the legs or frame of such structures which have a supporting framework.

DESCRIPTION OF THE PRIOR ART

Instant pop-up canopies and portable gazebos are the primary lightweight structures used to provide shelter for various outdoor events. They are the overhead cover of choice for vendors and exhibitors at art and craft shows, flea markets, farmers markets, and sporting events. Such a device is disclosed in U.S. Pat. No. 6,240,940. Some of the most notable manufacturers of such canopies are Caravan Instant Canopies, La Mirada, Calif., E-Z Up Instant Shelter, Riverside, Calif., and Quick Shade Instant Canopy, Santa Fe Springs, Calif. Depending on the size, instant canopies are constructed with either four or six telescoping legs joined to a collapsible upper metal frame that supports a fabric cover. Almost all of these structures manufactured by the aforementioned manufacturers have a footplate at the base of each leg. The footplate has a hole in which to stake down the leg. Due to potential liability of injury or possible product damage to nearby exhibitors or vendors, many event coordinators require these portable structures to have weighted or staked legs to prevent them from wind uplift. Many outdoor events are held on asphalt parking lots or concrete paved areas that do not allow the use of stakes. Some events are held on lawn or garden areas, and the use of stakes may cause damage to underground watering lines. Under these conditions the use of above-ground portable leg weights is required.

Some of the most common weights marketed today are made of sewn thick polyester fabric bags with compartments that are filled with sand, gravel, or rock. Each compartment is filled and closed with a zipper or a hook and loop (Velcro) flap. When filled, these weights are attached with hook and loop fasteners that wrap the weighted bags around each canopy leg. Some weight bags of this design are made to hang from the upper corners of the canopy frame. Weighted bags with compartments are prone to leakage when torn, zippers break, or the hook and loop closures fill with debris, rendering them almost useless. Other weights are plastic coated concrete or metal discs with an open ended slot to allow them to straddle the leg and rest on the footplate of each leg. Plastic coated concrete or metal discs are limited in size and do not provide sufficient weight required to prevent wind uplift. Multiple amounts of these weights are required on each leg to achieve optimum stability. Still, some weights are home-made of plastic pipe, filled with sand or concrete, and capped at each end. Home-made weights are costly, fabrication is time-consuming, and require some degree of knowledge of construction. It is also necessary to duct-tape or tie-wrap them to each leg. Duct-tape and tie-wraps are often difficult to remove after use. All of these variations are sold in sets of two or four.

Additional attempts to develop and patent a means of applying and securing portable weights to the leg frame of a pop-up canopy or gazebo are revealed in the following patents.

U.S. Pat. No. 5,737,883 shows a weight system that is attached to each leg of the canopy frame. Each weight is fabricated of numerous welded steel components, making it complicated and expensive to manufacture. Numerous protrusions make it difficult and hazardous to transport and store. Also, FIGS. 8, 9, and 10 show the use of threaded sockets and eyebolts to attach and secure the weight to the leg, which can damage the leg and scratch the powder coated or painted surface of the canopy legs.

U.S. Pat. No. 6,619,610 shows a design that describes only a stanchion or post of a free-standing tent without a flange, that penetrates the throughbore. This design will not work with a canopy fitted with a flanged footplate. A canopy with a flanged footplate would interfere with the throughbore as shown in FIGS. 2 and 3. This weight design is not compatible with canopies with flanged footplates.

U.S. Pat. No. 6,981,680 shows a series of portable weight plates with holes in which to stack and fasten multiple plates together. As with the previously cited patent, this design also does not allow the plate to slip over or through the flanged footplate. Instead, the weights are designed to sit under the flanged footplate. The canopy footplate is secured to the top surface of the weight plates with fasteners as shown in FIGS. 2 and 3. This invention requires the use of multiple weights and fasteners, and is time consuming to use.

SUMMARY OF THE INVENTION

The object of this invention is to provide a simple means of providing weights to each leg of the aforementioned portable structures. Another objective of this invention is to provide a simple method to attach and remove the weights from the legs of virtually any commercially available portable structure with leg footplates. Yet another objective is to provide a portable weight that will remain secured around each leg and not become dislodged or fall off under windy conditions.

The canopy weight case is preferably a blow-molded dual-walled hollow plastic case. Tooling used in this process can produce highly detailed shapes. The preferred material is High-Density Polyethylene (HDPE) plastic. The key advantages of this material are its relatively low cost, light weight, and impact resistant properties. The blow-molding process begins with melting pellets of plastic and forming it into a parison or preform. This much resembles the art of glass blowing. The parison or preform is a tube-like piece of molten plastic with a hole in one end in which compressed air can pass through. The parison or preform is then clamped into a mold, and air is pumped into it. The air pressure pushes the plastic out to match the inside shape of the mold. When the plastic has cooled and hardened, the mold is opened, and the hollow part is removed.

The present invention is comprised of two near symmetrical half-round hollow case halves which are flat at the top and bottom. The case halves are joined by a set of integrally molded hinges along one edge. The opposite edges are fashioned with two flexible plastic latches. The flexible plastic latches are retained on one side of the case half. Similarly, aligned latch detents are integrally molded in the opposite case half to snap the latches shut. The inner flat surface of each case half is fashioned with a full length V-groove which creates a square throughbore from top to bottom when the case halves are closed. The throughbore provides clearance to allow the case halves to wrap around the canopy leg. A filler hole and cap are provided at the top of each case half to fill and seal each case half with a variety of material such as sand, cement, steel, or a combination of these materials. Once filled and capped, the weighted case is ready for use.

In the primary method of use of this invention, each filled weight case is opened and placed at the base of the canopy leg on the footplate. The case is then closed or wrapped about the canopy leg and latched shut. Four or six weights are required for each application.

An alternate method of use of the invention is to hang the weight from the canopy frame. This may be a preferred method of use to avoid interference if a canopy accessory such as sidewalls or rail skirt is used. A rod is provided to allow the case to be hung from a canopy frame. When this method is used, the rod is removed from its nesting slot, and a rope is tied to the rod. The rod is placed on one side of the case in the half-depth grooves perpendicular to the V-groove. The case is then closed and latched. A matching aligned half-depth groove on the opposite case creates a full round cavity to entrap the rod when the case halves are closed. The opposite end of the rope exits through the top of the throughbore and is tied to the canopy frame, preferably directly above each leg. When not in use, this rod is retained and nested flush in a molded cavity in the inner flat of one case half.

Accordingly, in addition to the objects and advantages of my invention stated above, additional advantages of the invention are:

(a) A product that is quick, functional, and foolproof to use.
(b) A product that does not require repeated filling and empting for each use.
(c) A product that eliminates the possibility of filler material to leak out of its container.
(d) A product that is aesthetically pleasing.
(e) A product that is easy to handle and store.
(f) A product that is easy to clean.

Further improvements and benefits derived from this invention will become apparent from the drawings and ensuing description.

BRIEF DESCRIPTION OF THE DRAWINGS

The forementioned features of the invention will become more clearly understood from the following description read together with the accompanying drawings in which.

REFERENCE NUMERALS OF DRAWINGS

| | | | |
|---|---|---|---|
| 10 | present invention | 12A | latch |
| 12B | latch detent | 14 | hinge |
| 16 | flat inner surface | 18 | V-groove |
| 20 | throughbore | 22 | flat end |
| 24 | fill hole | 26 | fill cap |
| 28 | filler material | 30 | rod |
| 32 | rod nest | 34 | half-depth groove |
| 36 | logo pad | 38 | rope |
| 40 | canopy and cover | 42 | canopy leg |
| 44 | canopy leg footplate | 46 | canopy frame |

DETAILED DESCRIPTION OF THE DRAWINGS

Figure 1:
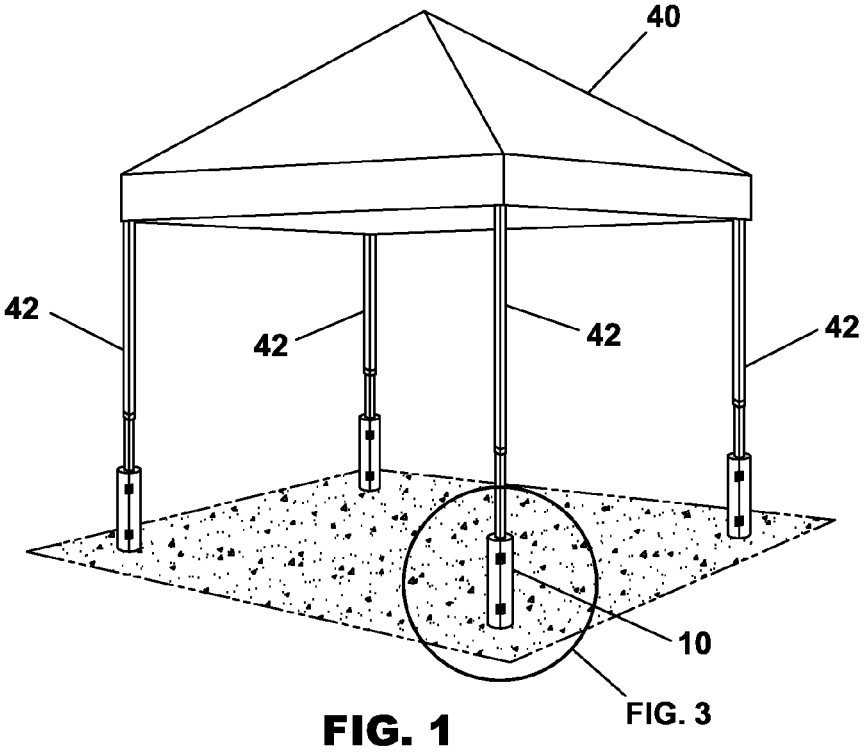
FIG. 1 is an isometric view of the invention on a canopy in the primary method of use.

FIG. 1 shows a perspective view of a pop-up canopy and cover 40 supported by four legs 42 with the present invention 10 in use applied to each leg 42 using the primary method.

Figure 2:
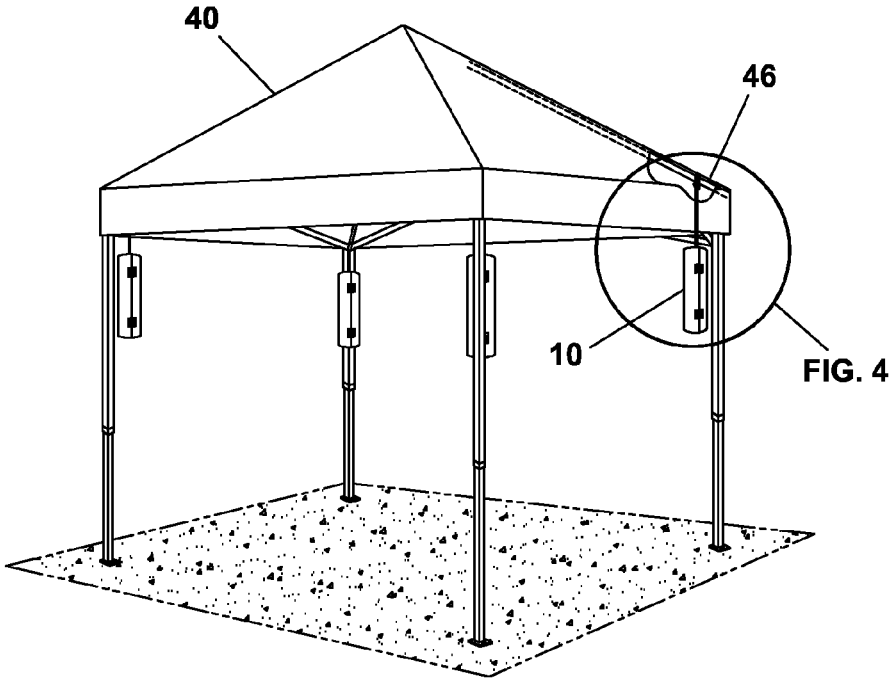
FIG. 2 is an isometric view of the invention on a canopy in the alternate method of use.

FIG. 2 shows a perspective view of a pop-up canopy and cover 40 with the present invention 10 in use using the alternative method of hanging to the canopy frame 46.

Figure 3:
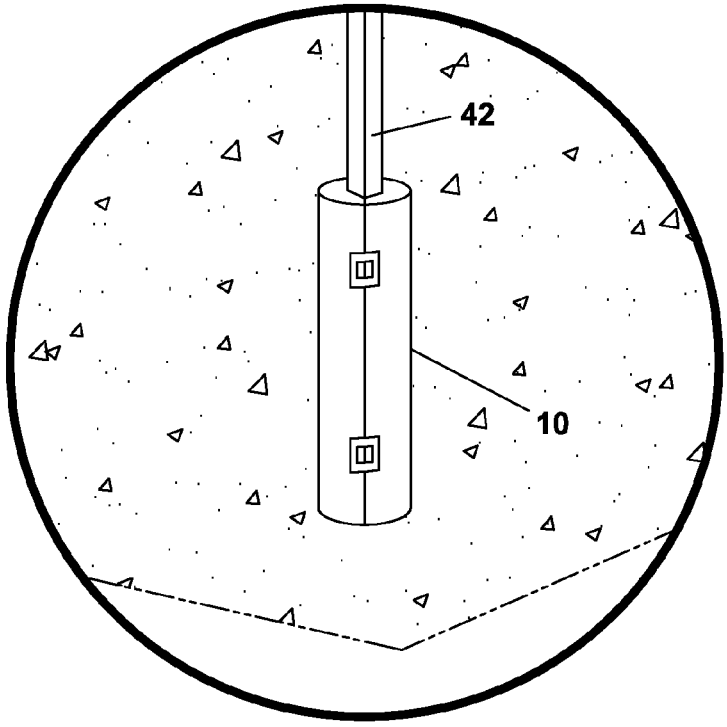
FIG. 3 is a close-up isometric view of the invention used in the primary method.

FIG. 3 shows a close-up view of the present invention 10 used in the primary method by wrapping around the canopy leg 42.

Figure 4:
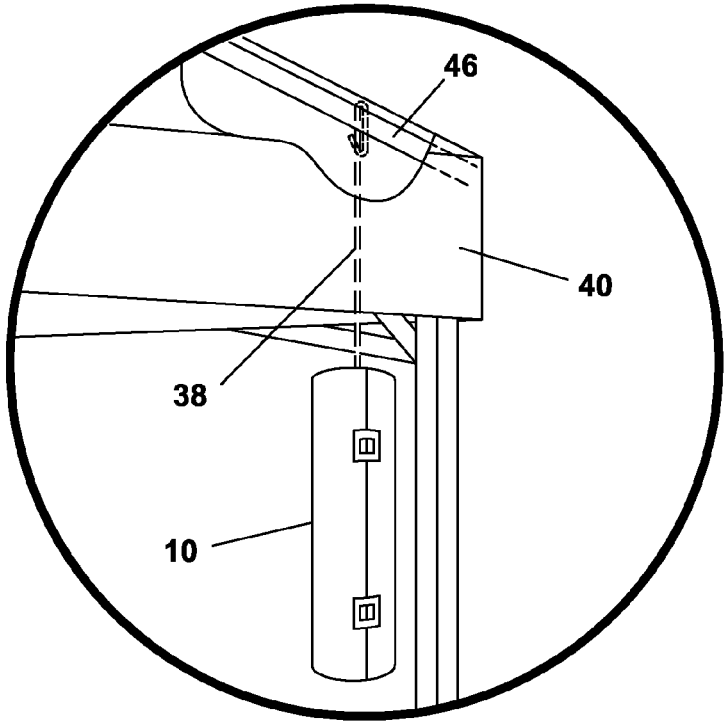
FIG. 4 is a close-up isometric view of the invention used in the alternate method.

FIG. 4 shows a close-up view of the present invention 10 used in the alternate method by attaching it with a rope 38 to the canopy 40 at the canopy frame 46.

Figure 5:
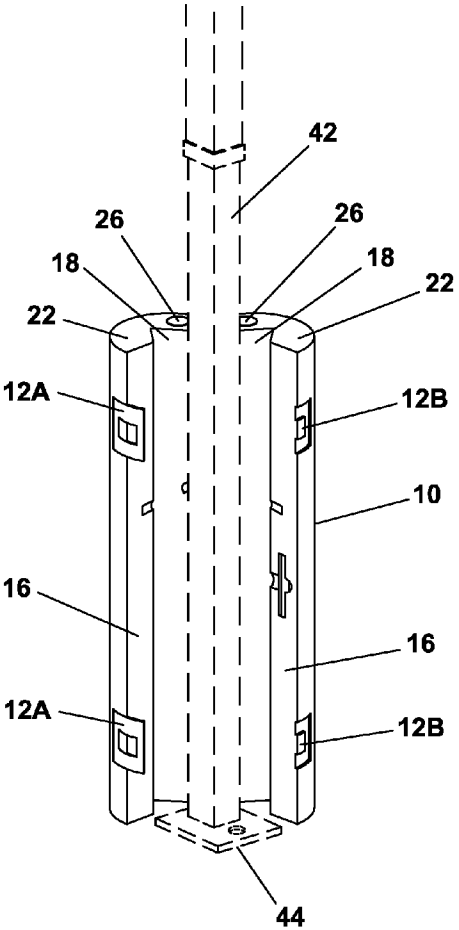
FIG. 5 is a close-up isometric view of the invention in the open position on the canopy leg footplate.

FIG. 5 shows a close-up view of the present invention 10 in the open position at the canopy leg 42 and resting on the canopy leg footplate 44.

Figure 6:
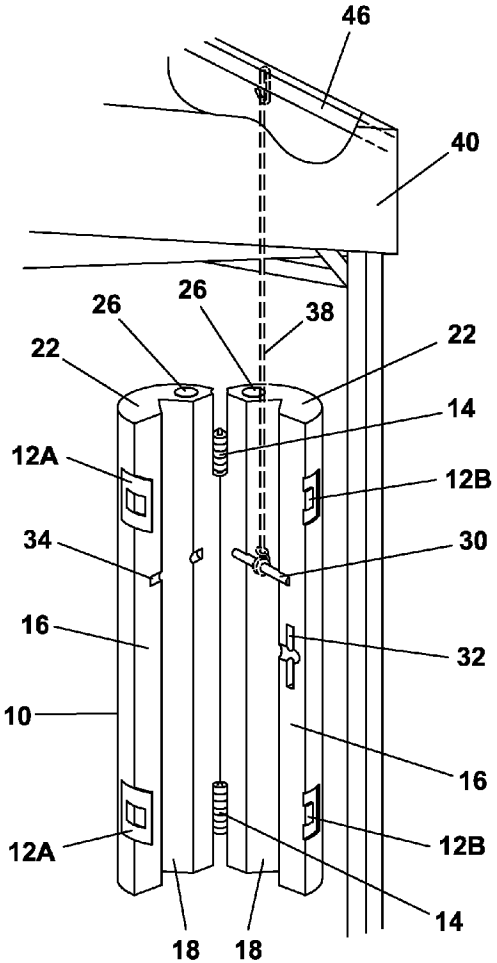
FIG. 6 is a close-up isometric view of the invention in the open position at the upper canopy frame.

FIG. 6 shows the present invention 10 in the open position. The rod 30 is removed from the rod nest 32, placed in the half-depth groove 34 on one case half, and fitted with a rope 38 and hung from the canopy 40 at the canopy frame 46.

Figure 7:
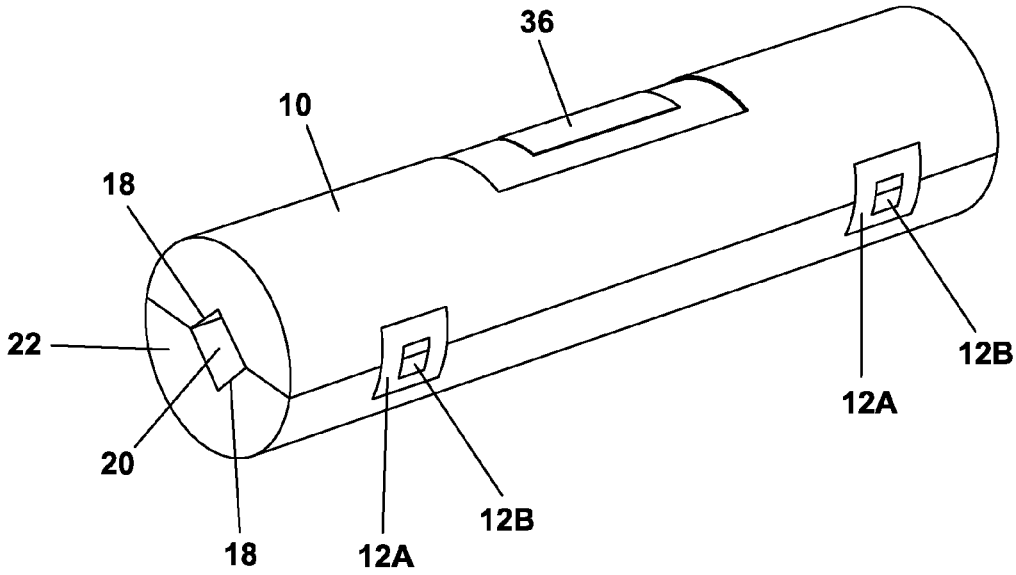
FIG. 7 is a front perspective view of the closed case.

FIG. 7 shows a front view of the present invention 10 in the closed position displaying the latches 12A, latch detents 12B, V-grooves 18, throughbore 20, flat end 22, and logo pad 36.

Figure 8:
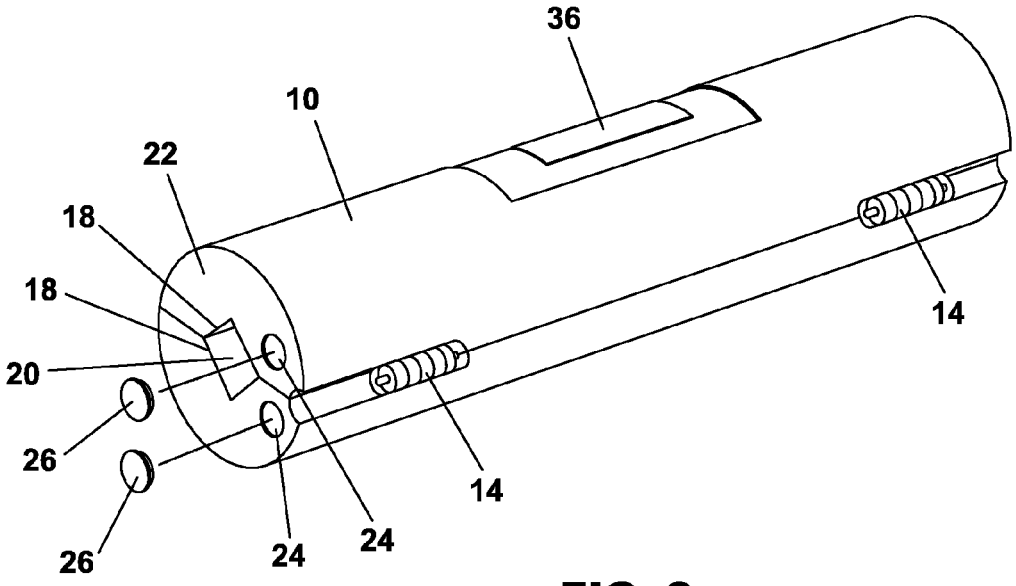
FIG. 8 is a back perspective view of the closed case.

FIG. 8 shows a back view of the present invention 10 in the closed position revealing the hinges 14, V-grooves 18, throughbore 20, flat end 22, fill holes 24, fill caps 26, and logo pad 36.

Figure 9:
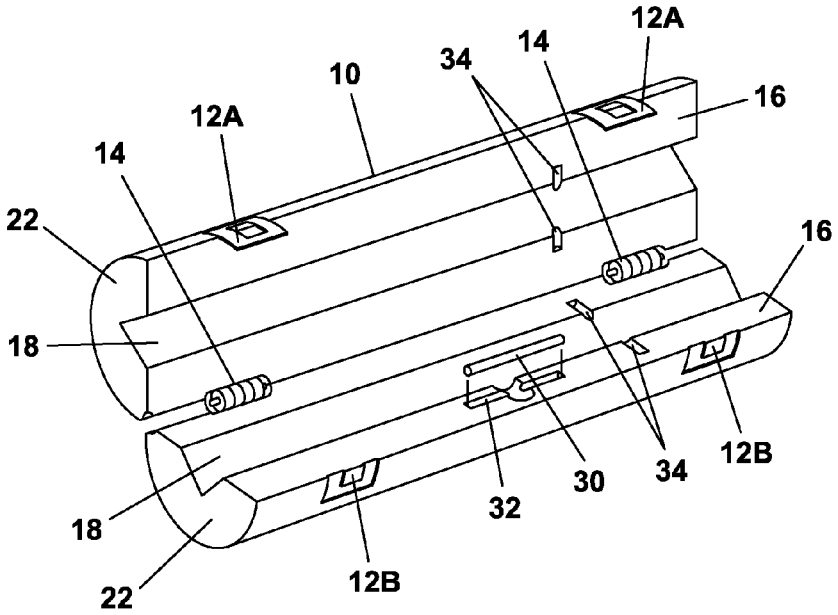
FIG. 9 is a frontal isometric view of the invention in the open position.

FIG. 9 shows a front view of the present invention 10 in the open position revealing some its features. Shown are the latches 12A, latch detents 12B, hinges 14, flat inner surfaces 16, V-grooves 18, flat ends 22, rod 30, rod nest 32, and half-depth grooves 34.

Figure 10:
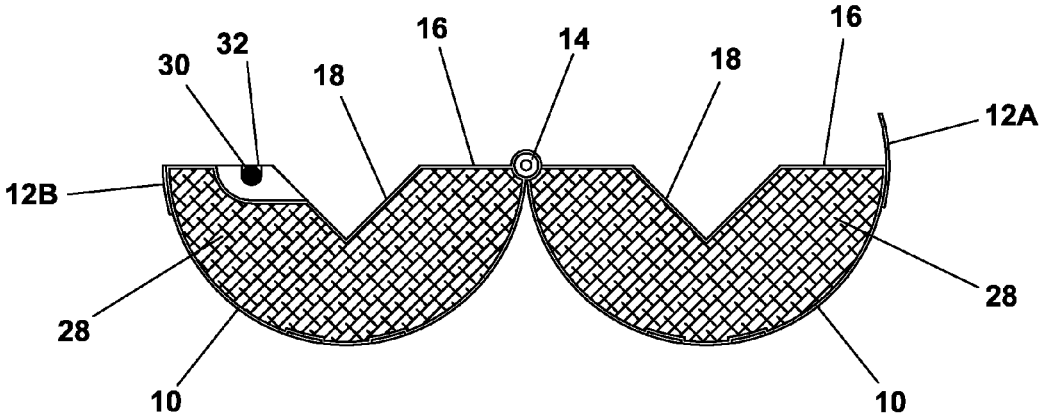
FIG. 10 is a sectional view through the case halves.

FIG. 10 shows a cross-section view of the present invention 10, latches 12A, latch detents 12B, hinges 14, flat inner surfaces 16, V-grooves 18, filler material 28, rod 30, and rod nest 32.

Figure 11:
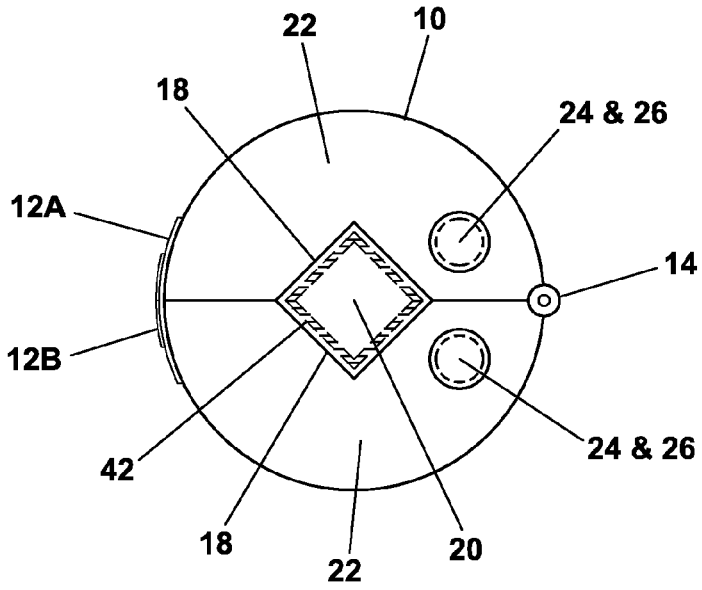
FIG. 11 is a top end view of the closed case.

FIG. 11 shows a top end view of the present invention 10 in the closed position, latches 12A, latch detents 12B, hinges 14, V-grooves 18, throughbore 20, flat ends 22, fill holes 24, fill caps 26, and canopy leg 42.

Figure 12:
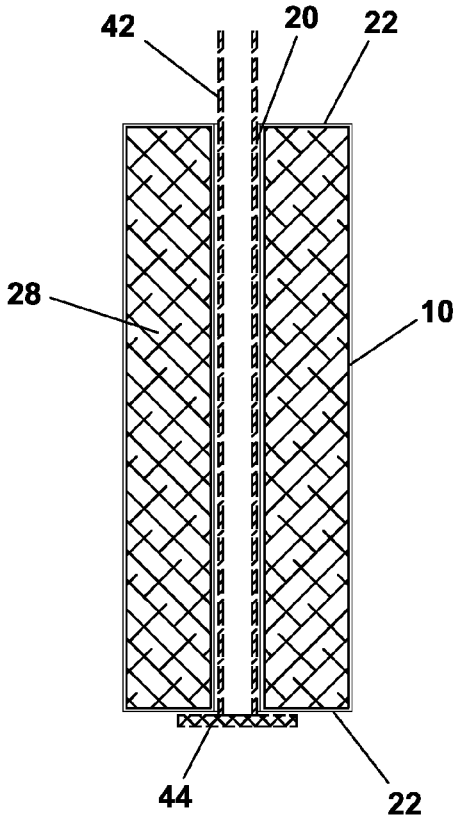
FIG. 12 is a sectional view of the invention in use resting on the canopy leg footplate.

FIG. 12 shows a longitudinal-sectional view of the present invention 10, throughbore 20, flat ends 22, and the filler material 28. It is shown wrapped around the canopy leg 42 and resting on the canopy leg footplate 44.

While the preferred embodiment is disclosed, it will be understood that there is no intent to limit the invention to such disclosure, but rather it is intended to cover all modifications and alternate materials and methods of construction falling within the field of this invention. For example, the present invention body could be fabricated of said (HDPE) plastic using the rotational-molding or pressure molding process. The present invention could be a multifaceted cylindrical octagon, or square shaped, rather than round and tubular. In addition, the V-shaped grooves could be half-round, creating a full circular throughbore instead of a square, or a rectangular groove, which produces a full square throughbore when the case halves are close. Additionally, the present invention could be fabricated of a cast concrete or plaster body and covered with a plastic protective skin and fitted with separately attached hinges and latches. Accordingly, the disclosure of the present invention is intended to be illustrative, but not limiting of the scope of the invention set forth in the following claims.

What is claimed is:

1. A portable canopy weight device configured to receive a variety of filler material and be attachable to a canopy leg or frame comprising:

a.) two near symmetrical hollow cylindrical case halves;

b.) said case halves being joined by integrally molded hinges along one edge;

c.) said case halves being fashioned with aligned plastic latches and integrally molded latch detents at the opposite edge;

d.) said case halves being fashioned with a flat surface at the top and bottom ends;

e.) said case halves being fashioned with a hole and cap at the top flat ends to allow filling with a variety of weight material and capped closed;

f.) said case halves being fashioned with flat inner surfaces which are fashioned with full length V-grooves, which when closed, produce a throughbore from top to bottom to allow passage of a canopy leg;

g.) said case halves wherein a rod is provided and retained in a flush rod nest which can be removed and fitted with a rope or strap and placed in matching half-depth grooves to allow it to be hung from the canopy frame.

2. The device in claim 1 wherein said case halves are fashioned with a raised logo pad on each outer surface to allow for product identification.

* * * * *